US010162297B2

(12) United States Patent
Lee et al.

(10) Patent No.: US 10,162,297 B2
(45) Date of Patent: Dec. 25, 2018

(54) IMAGE FORMING APPARATUS AND METHOD FOR CONTROLLING THE SAME AND COMPUTER-READABLE RECORDING MEDIUM

(71) Applicant: S-PRINTING SOLUTION CO., LTD., Suwon-si, Gyeonggi-do (KR)

(72) Inventors: Kyung-ha Lee, Suwon-si (KR); Jae-bum Yoo, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/648,005

(22) Filed: Jul. 12, 2017

(65) Prior Publication Data

US 2018/0032015 A1 Feb. 1, 2018

(30) Foreign Application Priority Data

Aug. 1, 2016 (KR) ..... 10-2016-0097799

(51) Int. Cl.
*G03G 15/00* (2006.01)
*G03G 15/16* (2006.01)

(52) U.S. Cl.
CPC ..... *G03G 15/5054* (2013.01); *G03G 15/1605* (2013.01); *G03G 15/5058* (2013.01)

(58) Field of Classification Search
CPC ..... G03G 15/5054; G03G 15/1605; G03G 15/5041; G03G 2215/0161; G03G 2215/0158
See application file for complete search history.

(56) References Cited

U.S. PATENT DOCUMENTS 6,693,654 B2 * 2/2004 Shinohara ..... G03G 15/0194 347/116
9,207,611 B2 12/2015 Woo et al.
2015/0023702 A1 * 1/2015 Cho ..... G03G 15/5058 399/301

FOREIGN PATENT DOCUMENTS

| | | |
|---|---|---|
| JP | 2009-122437 | 6/2009 |
| JP | 2011-141504 | 7/2011 |
| JP | 5045884 | 10/2012 |
| JP | 2014-164012 | 9/2014 |
| KR | 10-2014-0098487 | 8/2014 |

* cited by examiner

*Primary Examiner* — Sandra Brase
(74) *Attorney, Agent, or Firm* — Staas & Halsey LLP

(57) ABSTRACT

An image forming apparatus is provided. The image forming apparatus includes: a plurality of photosensitive drums; a plurality of exposurers exposing some area of surfaces of each of the plurality of photosensitive drums; a plurality of developers disposing a toner in the exposed area on the surfaces of each of the plurality of photosensitive drums; an intermediate transfer belt transferred with the toner disposed on each of the plurality of photosensitive drums to form a pattern; and a processor controlling the plurality of photosensitive drums or the plurality of exposurers to form a printed pattern on the intermediate transfer belt at a predetermined first concentration in response to a print command being input and form a registration pattern on the intermediate transfer belt at a second concentration lower than the first concentration in response to a registration command being input.

20 Claims, 10 Drawing Sheets

IMAGE FORMING APPARATUS AND METHOD FOR CONTROLLING THE SAME AND COMPUTER-READABLE RECORDING MEDIUM

CROSS-REFERENCE TO RELATED APPLICATIONS

This application claims priority from Korean Patent Application No. 10-2016-0097799 filed on Aug. 1, 2016 in the Korean Intellectual Property Office the disclosure of which is incorporated herein by reference in its entirety.

BACKGROUND

Field

Apparatuses and methods consistent with the present disclosure relate to an image forming apparatus, a method for controlling the same, and a computer-readable recording medium, and more particularly, to an image forming apparatus capable of reducing a concentration of a color registration pattern and reducing toner consumption and printing time, a method for controlling the same, and a computer-readable recording medium.

Description of the Related Art

Generally, an image forming apparatus means an apparatus that prints printing data generated from a printing control terminal device like a computer on a recording sheet. An example of the image forming apparatus may include a copier, a printer, a facsimile, a multi function peripheral (MFP) in which functions of them are compositely implemented in one apparatus, or the like.

Generally, an image forming apparatus such as a color laser printer has four photosensitive drums that are prepared corresponding to four colors of yellow, cyan, magenta, and black, an exposurer that scans light onto each of the four photosensitive drums to form an electrostatic latent image of a desired image, a developing solution that develops the electrostatic latent image with developers for each color, and image forming media (or transfer belt, intermediate transfer belt) that form color images completed by being sequentially and overlappingly transferred with images developed on each of the four photosensitive drums and then transfer the color images onto a sheet.

Therefore, to print a desired one color image, images for each color are developed on the four photosensitive drums to be overlappingly taken at the same image location on the transfer belt, thereby producing a final color image and print the color image on a sheet.

However, to superimpose four colors at the same image location on the transfer belt to accurately produce desired color images, the four colors need to be completely coincide at a location where a transfer of images from the respective photosensitive drums to the transfer belt starts and a location where the transfer of the images from the respective photosensitive drums to the transfer belt ends. This is because even if all the images are clearly developed on the four photosensitive drums, if the color images are transferred while being slightly shifted when being transferred to the transfer belt, the finally obtained color image does not have an accurate color and image.

However, an error caused when the photosensitive drums are not arranged correctly, an error in processing of an optical lens, and the like may occur to cause an alignment error of the color images. Therefore, to solve the above problem, a color registration (color registration or color alignment) job is required. At this point, auto color registration (ACR) for automatically performing the color registration depending on predetermined conditions may be performed. At this point, the concentration of the toner transferred to the transfer belt may be the highest concentration that can be output.

Meanwhile, the toner of a registration pattern transferred to the transfer belt contaminates a transfer roller. After the color registration is performed to remove the contamination of the transfer roller, there is a need to clean the transfer roller. However, if the concentration of the toner transferred to the transfer belt is the highest concentration, a considerable amount of toner is consumed every time the color registration is performed, which shortens the life of the toner and requires a considerable cleaning time for removing the contamination of the transfer roller, and delays the printing time.

Accordingly, a need exists for a technique of lowering the concentration of the color registration pattern to extend the life of the toner and to reduce the printing delay by the transfer roller cleaning.

SUMMARY

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides an image forming apparatus capable of reducing a concentration of a pattern formed during a color registration process to shorten toner consumption and printing time, a method for controlling the same, and a computer-readable recording medium.

According to an aspect of the present disclosure, an image forming apparatus includes: a plurality of photosensitive drums; a plurality of exposurers configured to expose some area of surfaces of each of the plurality of photosensitive drums; a plurality of developers configured to dispose a toner in the exposed area on the surfaces of each of the plurality of photosensitive drums; an intermediate transfer belt configured to be transferred with the toner disposed on each of the plurality of photosensitive drums to form a pattern; and a processor configured to control the plurality of photosensitive drums or the plurality of exposurers to form a printed pattern on the intermediate transfer belt at a predetermined first concentration if a print command is input and form a registration pattern on the intermediate transfer belt at a second concentration lower than the first concentration if a registration command is input.

The image forming apparatus may further include: a light emitter configured to irradiate light to a predetermined area of the intermediate transfer belt; and a sensor configured to detect light reflected from the intermediate transfer belt to generate a detection signal, in which the processor may control the light emitter and the sensor to be activated if the registration command is input and perform a registration correction based on the detection signal detected by the sensor.

Strength of the detection signal for the registration pattern formed at the second concentration may be within a predetermined range of strength of the detection signal for the printed pattern formed at the first concentration.

The strength of the detection signal for the registration pattern formed at the second concentration for yellow (Y), magenta (M), and cyan (C) colors may be equal to the strength of the detection signal for the printed pattern formed at the first concentration.

The image forming apparatus may further include: a storage configured to store information on a plurality of second concentrations each corresponding to a plurality of first concentrations in a look-up table, in which the information on the plurality of second concentrations may include at least one of a duty cycle, an exposure voltage, and a transfer voltage corresponding to the second concentration.

The processor may update the look-up table based on a detection signal for a concentration patch pattern differentiated from the registration pattern.

The processor may control the plurality of exposurers to expose an area corresponding to the printed pattern of the surfaces of each of the plurality of photosensitive drums at a predetermined first duty cycle if the print command is input and expose an area corresponding to the registration pattern of the surfaces of each of the plurality of photosensitive drums at a second duty cycle smaller than the first duty cycle if the registration command is input.

The processor may supply a predetermined first voltage to the exposurer if the print command is input and supply the second voltage lower than the first voltage to the plurality of exposurers if the registration command is input.

The processor may supply a predetermined first transfer voltage to the plurality of photosensitive drums if the print command is input and supply the second transfer voltage lower than the first transfer voltage to the plurality of photosensitive drums if the registration command is input.

The image forming apparatus may further include: a plurality of blades configured to clean a residual toner remaining on each of the plurality of photosensitive drums after the toner is transferred to the intermediate transfer belt depending on the supplied second transfer voltage.

According to another aspect of the present disclosure, a method for controlling an image forming apparatus includes: exposing some area of surfaces of each of a plurality of photosensitive drums; disposing a toner in the exposed area on the surfaces of each of the plurality of photosensitive drums; and transferring the toner disposed on each of the plurality of photosensitive drums to an intermediate transfer belt to form a pattern, in which in the forming of the pattern, a printed pattern may be formed on the intermediate transfer belt at a predetermined first concentration if a print command is input and a registration pattern may be formed on the intermediate transfer belt at a second concentration lower than the first concentration if a registration command is input.

The method may further include: irradiating light to a predetermined area of the intermediate transfer belt if the registration command is input; generating a detection signal by detecting light reflected from the intermediate transfer belt; and performing a registration correction based on the detection signal.

Strength of the detection signal for the registration pattern formed at the second concentration may be within a predetermined range of strength of the detection signal for the printed pattern formed at the first concentration.

The strength of the detection signal for the registration pattern formed at the second concentration for yellow (Y), magenta (M), and cyan (C) colors may be equal to the strength of the detection signal for the printed pattern formed at the first concentration.

The method may further include: storing information on a plurality of second concentrations corresponding to a plurality of first concentrations in a look-up table, in which the information on the plurality of second concentrations may include at least one of a duty cycle, an exposure voltage, and a transfer voltage corresponding to the second concentration.

The method may further include: updating the look-up table based on a detection signal for a concentration patch pattern differentiated from the registration pattern.

In the exposing, an area corresponding to the printed pattern of the surfaces of each of the plurality of photosensitive drums may be exposed at a predetermined first duty cycle if the print command is input and an area corresponding to the registration pattern of the surfaces of each of the plurality of photosensitive drums may be exposed at a second duty cycle smaller than the first duty cycle if the registration command is input.

In the exposing, the exposure may be performed at a predetermined first voltage if the print command is input and the exposure may be performed at the second voltage lower than the first voltage if the registration command is input.

In the forming of the pattern, a predetermined first transfer voltage may be supplied to the plurality of photosensitive drums if the print command is input and the second transfer voltage lower than the first transfer voltage may be supplied to the plurality of photosensitive drums if the registration command is input.

According to still another aspect of the present disclosure, in a computer-readable recording medium including a program for executing a method for controlling an image forming apparatus, the method for controlling an image forming apparatus includes: exposing some area of surfaces of each of a plurality of photosensitive drums; disposing a toner in the exposed area on the surfaces of each of the plurality of photosensitive drums; and transferring the toner disposed on each of the plurality of photosensitive drums to an intermediate transfer belt to form a pattern, in which in the forming of the pattern, a printed pattern is formed on the intermediate transfer belt at a predetermined first concentration if a print command is input and a registration pattern is formed on the intermediate transfer belt at a second concentration lower than the first concentration if a registration command is input.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
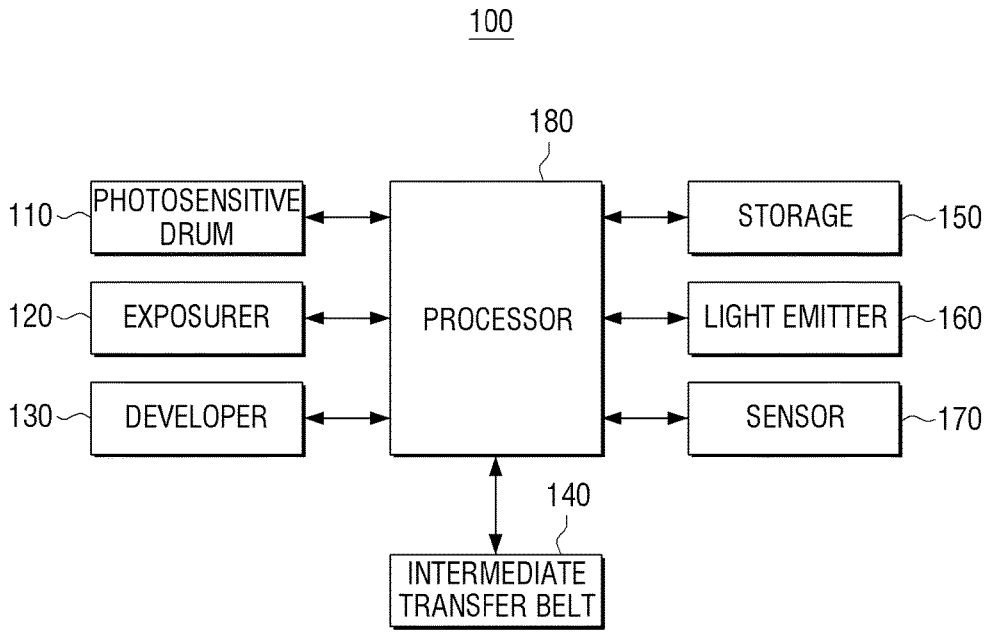
FIG. 1 is a block diagram illustrating a configuration of an image forming apparatus according to an exemplary embodiment of the present disclosure.

The present exemplary embodiments may be variously modified and have several forms. Therefore, specific exemplary embodiments of the present disclosure will be illustrated in the accompanying drawings and be described in detail in the present specification. However, the terms "include.", "configured.", or the like are not limited to features, figures, and one embodiment described in the specification, but includes all modifications, equivalents, and substitutions without departing from the scope and spirit of the present disclosure. When it is decided that the detailed description of the known art related to the present disclosure may obscure the gist of the present disclosure in describing embodiments, a detailed description therefor will be omitted.

Meanwhile, in the present specification, when any component is referred to as being "connected to" another component, it means that any one part and another part are "directly connected to" each other or are "connected to" each other with the other component interposed therebetween. In addition, unless explicitly described to the contrary, "comprising" any components will be understood to imply the inclusion of other elements rather than the exclusion of any other elements.

Terms 'first', 'second', and the like, may be used to describe various components, but the components are not to be construed as being limited by the terms. The terms are used to distinguish one component from another component.

Terms used in the present specification are used only to describe specific exemplary embodiments rather than limiting the scope of the present invention. Singular forms used herein are intended to include plural forms unless context explicitly indicates otherwise. It will be further understood that the terms "comprises" or "have" used in this specification, specify the presence of stated features, numerals, steps, operations, components, parts, or a combination thereof, but do not preclude the presence or addition of one or more other features, numerals, steps, operations, components, parts, or a combination thereof.

In the exemplary embodiments, a 'module' or a 'unit' may perform at least one function or operation, and be implemented by hardware or software or be implemented by a combination of hardware and software. Further, a plurality of 'modules' or a plurality of 'units' are integrated into at least one module except for the 'module' or 'unit' which needs to be implemented by specific hardware and thus may be implemented by at least one processor (not illustrated).

Meanwhile, the term "image forming job" used herein may mean various jobs (e.g., print, scan, or fax) related to an image such as formation of an image or creation/storage/transmission of an image file and the term "job" may mean not only the image forming job but also a series of processes required to perform the image forming job.

Further, the term "image forming apparatus" may mean all apparatuses capable of performing the image forming job such as a printer, a scanner, a fax machine, a multi-function printer (MFP), and a display device.

Further, the term "hard copy" may mean an operation of outputting an image to a print medium such as paper, and the term "soft copy" may mean an operation of outputting an image to display devices such as a TV and a monitor.

Also, the term "contents" may mean all kinds of data to be subjected to an image forming job such as a photograph, an image, and a document file.

Further, the term "printing data" may mean data converted into a printable format in the printer.

Further, the "scan file" may mean a file generated by scanning an image with a scanner.

Also, the term "user" may mean a person who performs an operation related to an image forming job using an image forming apparatus, or using a device connected with an image forming apparatus by wire or wireless. Also, the "manager" may mean a person who has authority to access all functions and systems of the image forming apparatus. The "manger" and "user" may be the same person.

FIG. 1 is a block diagram illustrating a configuration of an image forming apparatus according to an exemplary embodiment of the present disclosure.

Referring to FIG. 1, an image forming apparatus 100 includes a photosensitive drum 110, an exposurer 120, a developer 130, an intermediate transfer belt 140, a storage 150, a light emitter 160, a sensor 170, and a processor 180. Here, the image forming apparatus 100 may be an apparatus that performs generation, printing, reception, transmission, or the like, of image data and may include a printer, a copier, a facsimile, a multi-function device in which functions of the printer, the copier, the facsimile are integrated, and the like.

In the image forming apparatus 100, the photosensitive drum 110 is for transferring toner particles to paper and is exposed by the exposurer 120 to form electrostatic latent images for each color. At this point, the photosensitive drum 110 is illustrated as one or may be configured in plural and surfaces of each of the photosensitive drums 110 may be developed with yellow (Y), magenta (M), cyan (C), and black (B) images.

The exposurer 120 may form the electrostatic latent image so that the toner may be developed by irradiating light to the surface of the photosensitive drum 110 whose surface is uniformly charged by a corona discharge or the like. For example, the exposurer 120 may irradiate laser to the surface of the photosensitive drum 110 to change a surface potential of the photosensitive drum 110, thereby forming the electrostatic latent image. At this point, the exposurer 120 is illustrated as one, but may be configured in plural corresponding to each of the plurality of photosensitive drums 110.

Specifically, the exposurer 120 may expose the surface of the photosensitive drum 110 with a predetermined duty cycle. Here, the duty cycle means a ratio of time during which a current flows to one period (sum of time during which a current flows and time during which a current does not flow). In other words, the duty cycle may be a ratio of time during which the exposurer 120 is turned on to one period corresponding to one dot to be formed. For example, if the duty cycle is 100%, the exposurer 120 continues to operate for one period, and if the duty cycle is 50%, the exposurer 120 is operated for time corresponding to half of one period. In this way, a diameter of the dot may be controlled by adjusting the duty cycle of the exposurer 120.

For example, if a normal print command is input, the exposurer 120 exposes the surface of the photosensitive drum 110 at a first duty cycle to form a printed pattern at a first concentration, and if a registration command is input, the surface of the photosensitive drum 110 may be exposed at a second duty cycle smaller than the first duty cycle to form the registration pattern at the second concentration lower than the first concentration.

Meanwhile, the exposurer 120 may expose the surface of the photosensitive drum 110 at a predetermined exposure voltage. Specifically, if exposure is performed with a strong exposure voltage, the surface of the photosensitive drum 110 is strongly charged, and then an image having a higher concentration of at the time of toner placement by the developer 130 may be formed.

For example, if a normal print command is input, the exposurer 120 exposes the surface of the photosensitive drum 110 at a first voltage to form a printed pattern at a first concentration, and if a registration command is input, the surface of the photosensitive drum 110 may be exposed at a second voltage smaller than the first voltage to form the registration pattern at the second concentration lower than the first concentration.

The developer 130 may dispose the toner on the electrostatic latent image formed on the surface of the photosensitive drum 110 to form a visible image. Specifically, the developer 130 receives a toner therein, and supplies the toner to the electrostatic latent image to develop a visible image of the electrostatic latent image. The developer 130 may include a developing roller for supplying the toner to the electrostatic latent image. For example, the toner may be supplied from the developing roller to the electrostatic latent image formed on the photosensitive drum 110 by a developing electric field formed between the developing roller and the photosensitive drum 110 At this point, the developer 130 is illustrated as one but may be configured in plural corresponding to each of the plurality of photosensitive drums 110 and each developer 130 may dispose yellow, magenta, cyan, and black toners on the corresponding photosensitive drums 110.

The intermediate transfer belt 140 may be transferred with the toner disposed on the surface of the photosensitive drum 110 to form an image on the image forming medium like paper. Specifically, to form a color image, color toners are sequentially and overlappingly transferred from the plurality of photosensitive drums 110 on which the respective color toners are disposed. Accordingly, to print a desired one color image, images for each color is developed on the photosensitive drums 110 corresponding to the yellow, magenta, cyan, and black toners, and transferred so as to be superimposed on the same image location on the transfer belt to produce a final color image and print the produced final color image on a sheet.

At this point, the intermediate transfer belt 140 may be transferred with the toner disposed on the surface of the photosensitive drum 110 with a predetermined transfer voltage. Specifically, if the transfer is performed with a weak transfer voltage, only a part of the toner disposed on the surface of the photosensitive drum 110 may be transferred to the intermediate transfer belt 140.

For example, if a normal print command is input, the intermediate transfer belt 140 is transferred with the toner disposed on the surface of the photosensitive drum 110 at the first transfer voltage to form the printed pattern at the first concentration and if the registration command is input, may be transferred with the toner disposed on the surface of the photosensitive drum 110 at the second transfer voltage lower than the first transfer voltage to form the registration pattern at the second concentration lower than the first concentration.

The storage 150 stores printing data. Specifically, the storage 150 stores the printing data received from an external device. Further, the storage 150 stores history information on a print job performed by the image forming apparatus 100. Further, the storage 150 may store information on a registration pattern for image location registration and a concentration patch pattern for concentration registration.

Meanwhile, the storage 150 may be implemented as a storage medium in the image forming apparatus 100 and an external storage medium, for example, a removable disk including a USB memory, a web server though a network, and the like.

Further, the storage 150 may store information on a plurality of second concentrations corresponding to the plurality of first concentrations, respectively. Specifically, the storage 150 may store information on duty cycles of each of the plurality of exposurers 120 corresponding to each color, and may store information on a duty cycle of the case where the image forming apparatus 100 generally performs the printing driving, information on a duty cycle for forming a low concentration registration pattern, information on an exposure voltage supplied to the plurality of exposurers 120, and information on a transfer voltage supplied to the photosensitive drum 110. At this point, the storage 150 may store various information in a form of a look-up table. Further, the storage 150 may update and store the look-up table stored based on a detection signal for the concentration patch pattern under the control of the processor 180.

Meanwhile, programs such as an application and various kinds of data such as files may be installed and stored in the storage 150. The processor 180 may access and use the data stored in the storage unit 150 or may store new data in the storage 150. In addition, the processor 180 may execute programs installed in the storage 150. In addition, the processor 180 may install applications, which are received from the outside via a communicator (not illustrated), in the storage 150.

If the registration command is input, the light emitter 160 and the sensor 170 may be activated by the processor 180 to detect the registration pattern formed on the intermediate transfer belt 140.

In detail, the light emitter 160 may irradiate light to a predetermined region of the intermediate transfer belt 140 and the sensor 170 may detect light reflected from the intermediate transfer belt 140 to generate the detection signal. At this point, the light from the intermediate transfer belt 140 that is detected by the sensor 170 may be a regularly reflected wave irradiated from the light emitter 160. Here, the light emitter 160 may be implemented by an LED, and a control signal input to the light emitter 160 may be a PWM signal having a constant duty to control a light quantity of LED. Meanwhile, the detection signal generated by using the reflected light detected by the sensor 170 will be described in detail with reference to FIG. 4.

The processor 180 controls each component of the image forming apparatus 100. Specifically, if receiving the printing data from the print control terminal device, the processor 180 may control the photosensitive drum 110, the exposurer 120, the developer 130, the intermediate transfer belt 140, the transfer roller (not illustrated), a fixing device (not illustrated), and the like to print the received printing data. At this point, if the print command is input from the print control command, the processor 180 may control each component of the image forming apparatus 100 to form a printed pattern at a predetermined first concentration. For example, the first concentration at which the printed pattern is formed may be a maximum concentration that the image forming apparatus 100 may print or may be a concentration that a user sets. Meanwhile, the present exemplary embodiment describes that the printing data are printed in the case where the printing data are received from the external device, but when the image forming apparatus 100 is a multi function printer that may perform a copy job, the processor 180 may control each component of the image forming apparatus 100 so that the scanned printing data are printed.

If a predetermined event is generated, the processor 180 may perform the registration. Specifically, if the registration command is input, the processor 180 may control each component of the image forming apparatus 100 to form the registration pattern at the second concentration lower than the first concentration. For example, the processor 180 may perform the registration before the printing is performed, when parts of the image forming apparatus 100 are replaced, when the image forming apparatus 100 is initialized, and when accurate color registration is required. Meanwhile, the processor 180 may perform the registration while the printing is performed, which may be a wait time before the start of printing of the next page after which one of pages is printed, if the print command for the plurality of pages is input.

Meanwhile, if the user input a registration execution command through the input (not illustrated), the processor 180 may perform the registration. At this point, when the user inputs a command to perform the low concentration registration, the processor 180 may control each component of the image forming apparatus 100 to form the low concentration registration pattern.

Meanwhile, the processor 180 may form a low concentration registration pattern by reducing a size of dots of the registration pattern to be formed or controlling a darkness level of a dot.

Specifically, the processor 180 may reduce a size of dots of the registration pattern formed by adjusting the duty cycle. At this point, the duty cycle may be determined based on the pre-stored look-up table or the concentration detected by the light emitter 160 and the sensor 170 in the concentration patch pattern. The contents of determining the duty cycle based on the concentration detected by the sensor 170 will be described in detail with reference to FIGS. 5 and 6.

Further, the processor 180 may adjust the darkness level of the dot by reducing the voltage supplied to the exposurer 120 and the transfer voltage supplied to the photosensitive drum 110. Specifically, the processor 180 may reduce the voltage supplied to the exposurer 120 to reduce the amount of toner disposed on the photosensitive drum 110 and reduce the transfer voltage supplied to the photosensitive drum 110 to reduce the amount of toner transferred to the intermediate transfer belt 140. Meanwhile, to reduce the transfer voltage, the image forming apparatus 100 may further include a blade 193 for cleaning the residual toner that remains on the photosensitive drum 110 without being transferred to the intermediate transfer belt 140. The image forming apparatus may include a plurality of blades 193 configured to clean a residual toner remaining on the plurality of photosensitive drums 110.

Meanwhile, the processor 180 may perform a registration correction on the location and the concentration according to the result of performing the registration. Specifically, the processor 180 may detect the light reflected from the registration pattern formed on the intermediate transfer belt 140 and perform the registration correction based on the generated signal.

Meanwhile, the processor 180 may repeat an operation of alternately applying a voltage to the intermediate transfer belt 140 and the transfer roller to clean the transfer roller (not illustrated) contaminated by the performance of the registration. In addition, the image forming apparatus 100 may further include a blade 193 that cleans the transfer roller to remove the toner transferred to the intermediate transfer belt 140.

Meanwhile, although not illustrated in the drawings, the image forming apparatus may further include an input for receiving a user's operation, a communicator for connecting to the external device such as the print control terminal, or the like.

Specifically, an input/output may include an input for receiving an input or the like for performing an image forming job from a user and an output for displaying information such as a result of performing the image forming job or a state of the image forming apparatus. For example, the input/output may include an operation panel for receiving a user input, a display panel for displaying a screen, or the like. Specifically, the input may include devices capable of receiving various types of user inputs, such as, for example, a keyboard, a physical button, a touch screen, a camera, and a microphone. Further, the output may include, for example, a display panel or a speaker, or the like. However, the input/output are not limited thereto, and therefore the input/output may include a device supporting various inputs/outputs.

The processor 180 may control the overall operation of the image forming apparatus and may include a CPU or the like. The processor 180 may control other components included in the image forming apparatus to perform an operation corresponding to the user input received through the input/output. For example, the processor 180 may execute a program stored in the storage 150, read a file stored in the storage 150, or store a new file in the storage 150.

Meanwhile, the communicator may perform wired/wireless communication with another device or a network. To this end, the communicator may include a communication module supporting at least one of various wired/wireless communication methods. For example, the communication module may be a chipset form, or may be a sticker/barcode (e.g., sticker containing an NFC tag) or the like that includes information necessary for communication.

The wireless communication may include at least one of, for example, wireless fidelity (Wi-Fi), Wi-Fi direct, Bluetooth, ultra wide band (UWB), or near field communication (NFC). The wired communication may include at least one of, for example, USB or high definition multimedia interface (HDMI).

The communicator may be connected to an external device located outside the image forming apparatus to transmit/receive signals or data. The communicator may transmit the signals or data received from the external device to the processor 180 or may transmit signals or data generated by the processor 180 to the external device. For example, if the communicator receives the print command signal and the printing data from the external device, the processor 180 may output the received printing data.

Meanwhile, as described above, if the print command is input, the image of the printed pattern formed on the intermediate transfer belt 140 is formed on the image forming media such as paper and is output, if the registration command is input, the registration pattern formed on the intermediate transfer belt 140 without supplying the image forming medium is restrictively illustrated and described as being detected by the light emitter 160 and the sensor 170. However, in the actual implementation, even when the registration command is input, the image of the registration pattern is formed on the image forming media such as paper and is output, and the output registration image may also be implemented in the form detected by the light emitter and the sensor that are separately provided.

As described above, according to the various embodiments of the present disclosure, the registration pattern may be formed at a low concentration to shorten the toner consumption and the printing time.

Figure 2:
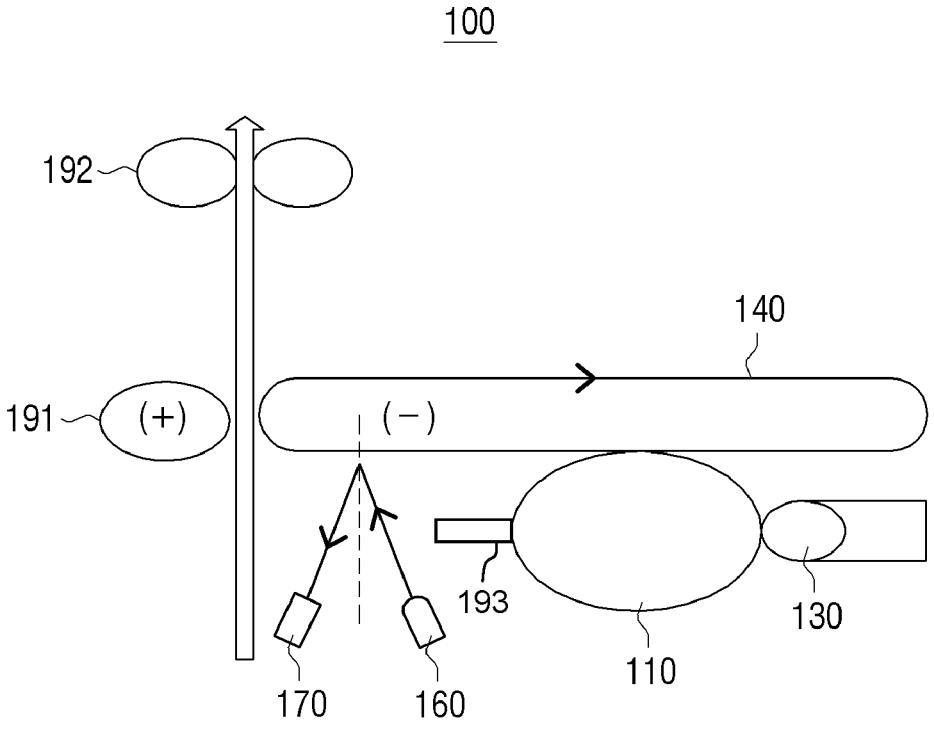
FIG. 2 is a diagram schematically illustrating the configuration of the image forming apparatus according to the exemplary embodiment of the present disclosure.

FIG. 2 is a diagram schematically illustrating the configuration of the image forming apparatus according to the exemplary embodiment of the present disclosure.

Referring to FIG. 2, the image forming apparatus 100 includes the photosensitive drum 110, the developer 130, the intermediate transfer belt 140, the light emitter 160, the sensor 170, a transfer roller 191, and a fixing device 192. Meanwhile, FIG. 2 illustrates the image forming apparatus including one photosensitive drum 110 and one developer 130, but in the actual implementation, for example, the photosensitive drum 110 and the developer 130 each corresponding to colors such as yellow, magenta, and cyan may be provided in plural.

Although not illustrated, the image forming apparatus 100 may further include the exposurer that exposes the surface of the photosensitive drum 110, and the exposurer may also be provided in plural corresponding to each of the plurality of photosensitive drums.

Meanwhile, if a predetermined event for performing the registration is generated, that is, if the registration command is input, the exposurer (not illustrated) may expose the surface of the photosensitive drum 110 by the control of the image forming apparatus 100. At this point, the exposurer (not illustrated) may expose a region corresponding to the registration pattern on the surface of the photosensitive drum 110. Further, the exposurer may expose the surface of the photosensitive drum 110 with a duty cycle smaller than a duty cycle in the general image formation to form the registration pattern of the second concentration lower than the first concentration at the time of performing the normal print command. A method for determining a duty cycle to form a low concentration registration pattern will be described in detail with reference to FIGS. 5 and 6.

Meanwhile, the image forming apparatus 100 may apply a voltage lower than the voltage at the time of the normal image formation to the exposurer to form the low concentration registration pattern, such that the surface of the photosensitive drum 110 may be exposed at the lower voltage. Meanwhile, it is described that the image forming apparatus is operated separately like reducing the duty cycle or reducing the voltage applied to the exposurer to form the low concentration registration pattern. However, in the actual implementation, the image forming apparatus may also be implemented by the scheme of reducing the duty cycle and reducing the exposurer applying voltage together.

The developer 130 may dispose the toner on the surface of the photosensitive drum 110 on which the registration pattern area is exposed. Specifically, the surface of the photosensitive drum 110 may be exposed at the reduced duty cycle or the reduced voltage by the exposurer or exposed to a reduced voltage, and thus the amount of toner to be disposed may be reduced from the developer 130.

The intermediate transfer belt 140 may be transferred with the toner from the photosensitive drum 110 on which the toner is disposed in the registration pattern area. FIG. 2 illustrates that the toner is transferred from one photosensitive drum 110. However, in the actual implementation, the plurality of photosensitive drums 110 are arranged in a row, such that the toner of the corresponding color may be sequentially and overlappingly transferred from the plurality of photosensitive drums 110 to implement various colors. For example, if the plurality of photosensitive drums 110 are arranged in a row, the intermediate transfer belt 140 may be sequentially transferred with the toners of colors corresponding to each photosensitive drum from the rightmost photosensitive drum to the leftmost photosensitive drum.

At this point, the image forming apparatus 100 may reduce the concentration of the registration pattern by adjusting the transfer voltage supplied to the photosensitive drum 110 for transferring the toner. At this point, the image forming apparatus 100 may further include a blade 193 that cleans the residual toner remaining on the photosensitive drum 110 after only a part of the toner disposed on the photosensitive drum 110 is transferred depending on the reduced transfer voltage.

Meanwhile, if the toners are transferred from each of the plurality of photosensitive drums 110 to complete the registration pattern on the intermediate transfer belt 140, the light emitter 160 may irradiate light to the intermediate transfer belt 140 and the sensor 170 may detect the light reflected from the intermediate transfer belt 140 to generate the detection signal. At this point, the sensor 170 may detect light that is irradiated from the light emitter 160 and regularly reflected by the intermediate transfer belt 140. Unlike the diffuse reflection, the light regularly reflected from the color image such as yellow, magenta, and cyan has the concentration of the image and the detection signal that are not proportional to each other, such that it has an inflection line in which the detection signal is not linearly increased as the concentration is increased. The duty cycle for the low concentration registration may be determined using the feature of the regularly reflected light without linearly increasing as the concentration is increased, which will be described below in detail with reference to FIG. 5.

Meanwhile, according to the present exemplary embodiment, the intermediate transfer belt 140 is moved from the right to the left to be transferred with the toner, such that the light emitter 160 and the sensor 170 may be disposed at the left of the plurality of photosensitive drum 110. At this point, the sensor 170 may generate the detection signal by detecting the location and the concentration of the formed registration pattern, and the image forming apparatus 100 may perform the registration correction based on the generated detection signal. Meanwhile, the exemplary embodiment of the registration pattern will be described in detail with reference to FIG. 3.

Meanwhile, the transfer roller 191 may be contaminated by the registration pattern formed on the intermediate transfer belt 140 during the registration performance. This is because the toner formed on the intermediate transfer belt 140 is transferred to paper by the transfer roller 191 charged while paper passes between the intermediate transfer belt 140 and the transfer roller 191 and unlike the normal printing process of fixing the toner to paper by applying heat and pressure by the fixing device 192, there is no paper, which is a print medium, between the intermediate transfer belt 140 and the transfer roller 191 during the registration performance. As a result, the toner on the intermediate transfer belt 140 may be transferred to the transfer roller 191.

Therefore, to prevent the opposite surface other than the surface on which printing is performed from being contaminated due to the toner transferred to the transfer roller 191 when the registration performance is completed and then the printing is performed, the step of cleaning the transfer roller 191 is essential. The method for cleaning the transfer roller 191 in the registration process is well known in the art, and therefore a detailed description thereof will be omitted. On the other hand, the image forming apparatus may further include a blade 193 that cleans the residual toner remaining on the intermediate transfer belt 140 after the registration performance is completed, and the transfer roller 191 to remove the toner transferred to the intermediate transfer belt 140.

On the other hand, as described above, it is possible to reduce the amount of toner used for the registration and shorten the time to clean the transfer roller 191 by forming the registration pattern at a low concentration.

Meanwhile, even when the registration command is input, the registration pattern formed on the intermediate transfer belt 140 may be implemented to be printed on the paper that is the print medium, and the printed registration pattern may be detected by the light emitter and the sensor that are provided separately. In this way, it is possible to reduce the amount of toner used for the registration by forming the low concentration registration pattern on the print medium.

Figure 3:
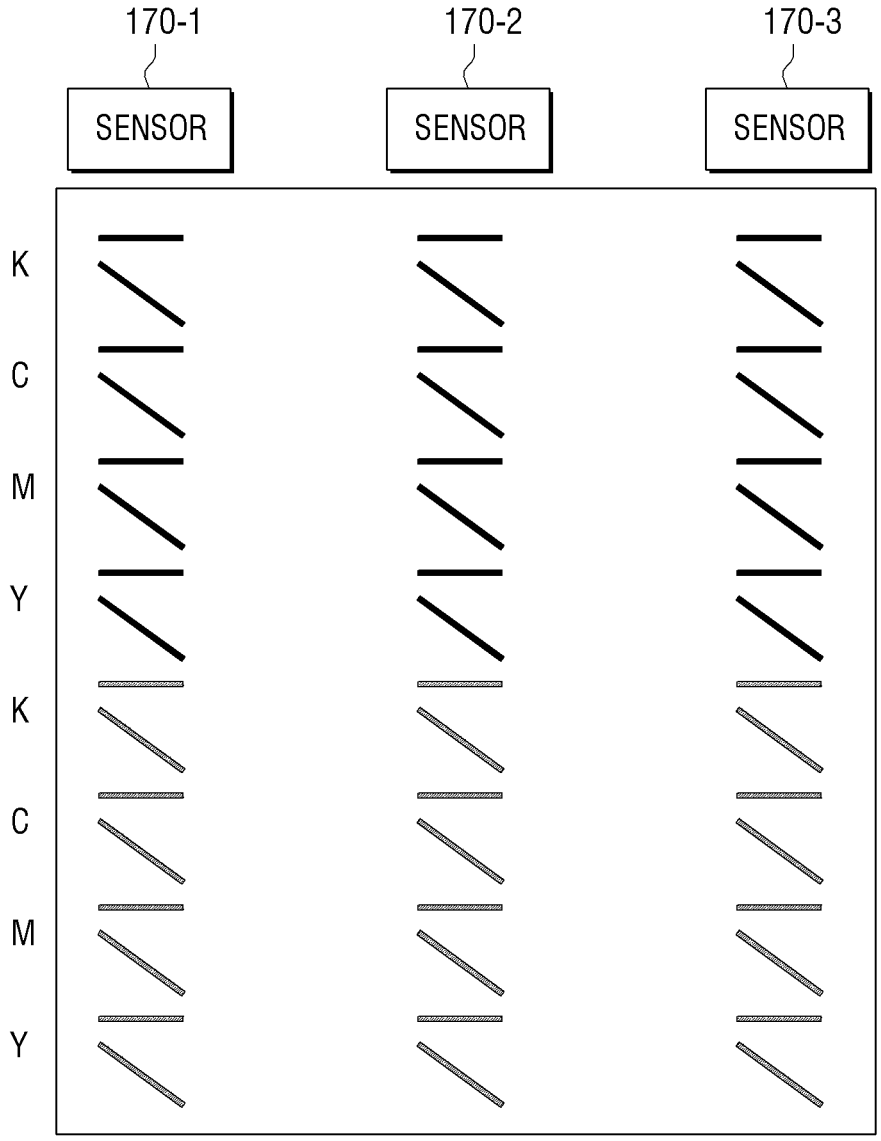
FIG. 3 is a diagram illustrating an example of a registration pattern.

FIG. 3 is a diagram illustrating an example of the registration pattern.

Referring to FIG. 3, the registration patterns may be sequentially formed for each color supported by the image forming apparatus in predetermined areas of the intermediate transfer belt corresponding to the location of each of the plurality of sensors 170-1, 170-2, and 170-3. Specifically, the image forming apparatus may form a black (K) pattern in three regions with respect to a main scanning direction, form a cyan (C) pattern in three regions after a predetermined time (or distance), forms a magenta (M) pattern in three regions after the same predetermined time (or distance), and form a yellow (Y) pattern in three regions after the same predetermined time (or distance).

The plurality of sensors 170-1, 170-2, and 170-3 generate a detection signal by detecting the light reflected from the intermediate transfer belt, and the image forming apparatus may perform the registration correction depending on locations of a plurality of lines forming the registration pattern determined based on the generated detection signal, a thickness of the lines, a distance between the lines, an angle of the lines, or the like.

Meanwhile, as described above, after the pattern for the location registration correction for each color is formed at the highest concentration at which the image forming apparatus may be output, the concentration patch pattern for the concentration correction may be formed. Specifically, the registration pattern having a lower concentration than the highest-concentration registration pattern formed may be formed.

The image forming apparatus may perform the concentration registration correction depending on the generated detection signal generated depending on the concentration of the pattern from the plurality of sensors 170-1, 170-2, and 170-3, and may update the look-up table stored in the storage based thereon and store the updated look-up table again.

Meanwhile, it is described above that the location registration and the concentration registration are simultaneously performed, but the location registration and the concentration registration may each be performed with a time difference.

Figure 4:
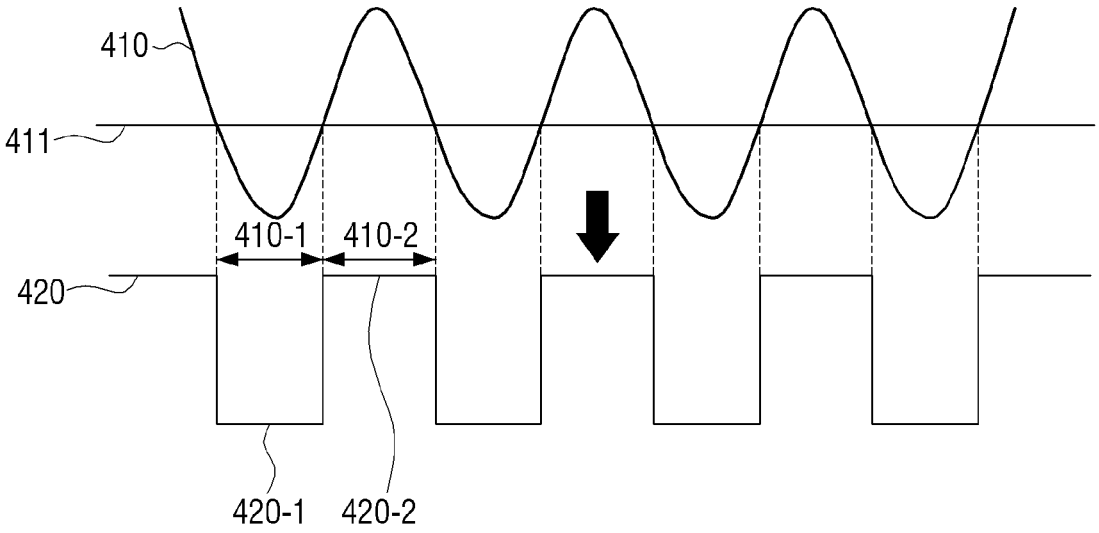
FIG. 4 is a diagram for describing a detection signal generated by a sensor.

FIG. 4 is a diagram for describing a detection signal generated by a sensor.

Referring to FIG. 4, the image forming apparatus may detect a pattern depending on a detection signal 420 generated based on an analog signal 410 detected by a sensor. Specifically, the sensor may detect the analog signal 410 corresponding to the light reflected from the intermediate transfer belt, and generate the detection signal 420 based thereon. More specifically, the sensor may divide a range 410-1 having a signal value equal to or less than a predetermined reference value 411 in the detected analog signal 410, and a range 410-1 having a signal value equal to or greater than the predetermined reference value 411 to generate the detection signal 420.

At this point, the image forming apparatus may recognize that the pattern exists in the range 420-1 corresponding to the range 410-1 having the signal value equal to or less than the predetermined reference value 411 in the generated detection signal 420 and the pattern does not exist in the range 420-2 corresponding to the range 410-2 having the signal value equal to or greater than the predetermined reference value 411 in the generated detection signal 420.

Meanwhile, it is described above that the sensor generates the digital type detection signal 420 by detecting the analog type light. However, the detection signal may be generated as another analog signal and the range having the signal value equal to or greater than the predetermined reference value according to the detection scheme may be recognized as the area in which the pattern exists.

Figure 5:
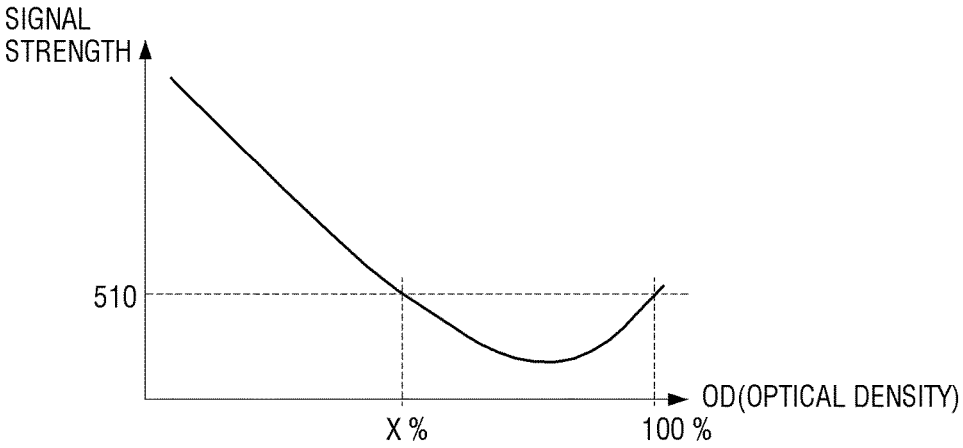
FIGS. 5 and 6 are diagrams illustrating a relationship between strength of the detection signal generated by the sensor and OD.
Figure 6:
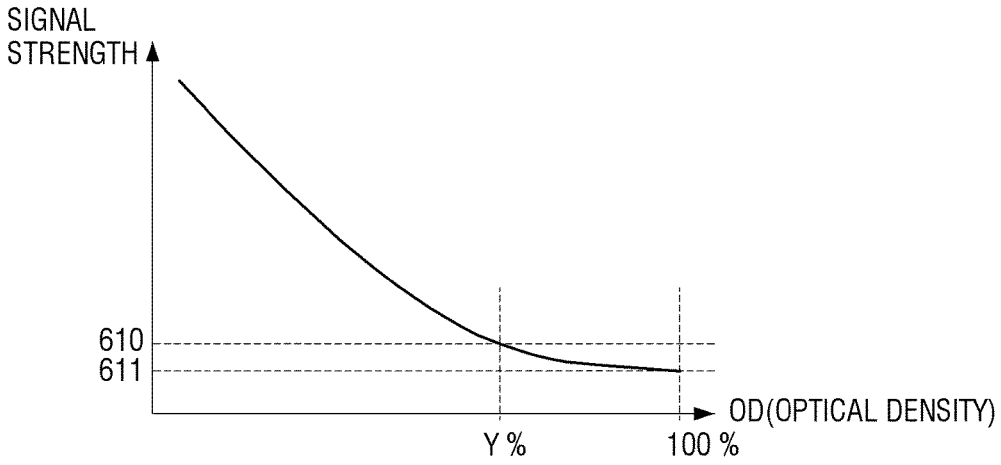

FIGS. 5 and 6 are diagrams illustrating a relationship between strength of the detection signal and an optical density (OD).

Specifically, FIG. 5 is a graph illustrating the relationship between the optical density (OD) and the strength of the detection signal when the registration pattern is formed using colored toners such as yellow, magenta, and cyan. In this case, the OD means the optical density, that is, the concentration that may be confirmed by eyes. That is, the OD means the concentration of the registration pattern. The reduction in the concentration of the registration pattern means that the darkness level of dots itself is reduced or the darkness level of dots is maintained but the size of dots is reduced and thus, the concentration of the pattern is reduced in general perspective. At this point, the sensor may detect the regularly reflected wave reflected from the registration pattern formed on the intermediate transfer belt.

Referring to FIG. 5, the strength of the regularly reflected wave signal detected from the registration pattern formed of the colored toner is not formed linearly. That is, as the concentration of the pattern increases, the signal strength does not change linearly but has an inflection point. As a result, strength equal to strength 510 of the signal detected by forming the registration pattern at the highest concentration (100%) that may be output from the image forming apparatus is detected, but a concentration of x % lower than that of 100% exists. In other words, even if the registration pattern is formed at a lower concentration, the image forming apparatus may detect the signal of the same strength to perform the registration.

In this way, if the image forming apparatus determines a concentration for the registration pattern using the strength of the detection signal, the registration pattern having the concentration determined by adjusting the size of dots or the darkness level of dots may be formed. This will be described in detail with reference to FIGS. 7 to 9.

Meanwhile, in the above description, the concentration having the signal strength equal to the highest concentration of the image forming apparatus is determined as the concentration of the low concentration registration pattern, but may also be selected from the concentration range having the signal strength within the predetermined range. For example, the concentration of the low concentration registration pattern may be selected in a concentration range of more than x % to less than 100%.

Meanwhile, FIG. 6 is a graph illustrating the relationship between the optical density (OD) and the strength of the detection signal when the registration pattern is formed using a colorless toner such as black.

Referring to FIG. 6, the strength of the regularly reflected wave signal detected from the registration pattern formed of the colorless toner is not formed linearly. However, unlike the colorless toner, the signal strength does not have an inflection point. However, as the concentration approaches 100% that is the highest concentration, the signal strength is little changed. As a result, the image forming apparatus may determine any one of the concentrations having signal strength in a range between a predetermined reference value 610 in which the existence of the pattern may be recognized or signal strength 611 in the case of the highest concentration as the concentration of the low concentration registration pattern. For example, the concentration of the low concentration registration pattern may be selected in a concentration range of more than y % to less than 100% which is a concentration corresponding to the predetermined reference value 610. Meanwhile, the predetermined reference value 610 in which the image forming apparatus may recognize that the pattern exists is a variable value, and may be set by the user.

Figure 7:
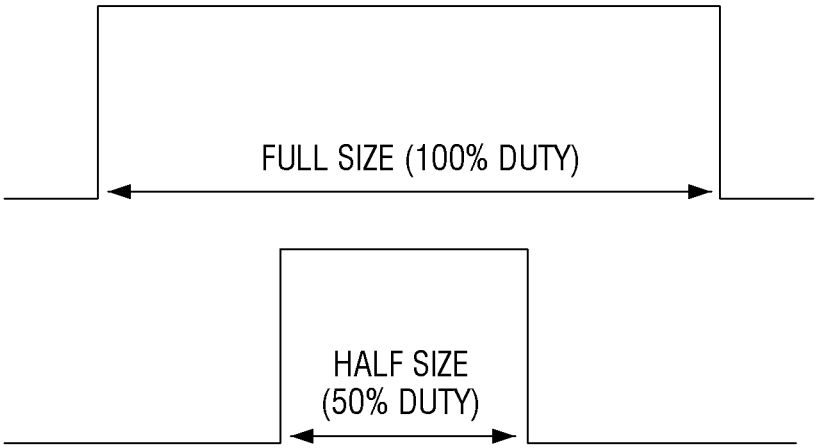
FIG. 7 is a diagram for describing a size of a dot depending on a duty cycle.

FIG. 7 is a diagram for describing a size of dots depending on a duty cycle.

Referring to FIG. 7, if a pattern is formed by driving the exposurer with a 100% duty cycle, a dot having a full-size diameter may be formed. In contrast, if a pattern is formed by driving the exposurer with a duty cycle of 50%, a dot having a half-size diameter may be formed. That is, the size of dots may be adjusted by adjusting the time during which the exposurer is operated depending on the duty cycle. At this point, a duty cycle of 100% may be a duty cycle when the normal printing is performed, and a duty cycle of 50% may be a duty cycle when the low concentration registration is performed. Here, the duty cycle may be determined based on the concentration having the signal strength within the predetermined range as illustrated in FIGS. 5 and 6 above.

At this point, the determined duty cycle may be determined by detecting the concentration patch pattern every time the registration is performed and comparing the strength of the signal detected depending on each concentration.

Meanwhile, the duty cycle for generating the low concentration registration pattern may be a value input by manufacturers. Specifically, the duty cycle may be stored in the storage of the image forming apparatus in the form of the look-up table. At this point, the stored look-up table may include information on information on the second duty cycle corresponding to the first duty cycle when printing is normally performed. Specifically, the information on the second duty cycle may include information on a plurality of duty cycles that may applied to each of the plurality of exposurers corresponding to the respective colors. Meanwhile, the look-up table may include a plurality of first duty cycles and second duty cycles corresponding to the plurality of first duty cycles, respectively.

Figure 8A:
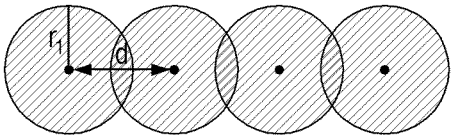
FIGS. 8A and 8B are diagrams for describing an exemplary embodiment in which the size of the dot is changed to reduce a concentration of an image of a registration pattern.
Figure 8B:
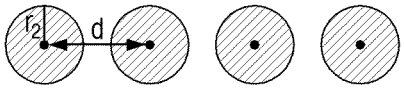

FIGS. 8A and 8B are diagrams for describing an exemplary embodiment in which the size of dots is changed to reduce a concentration of an image of a registration pattern.

Specifically, FIG. 8A may be a dot formed with the duty cycle when the normal printing is performed. At this point, a radius of a dot may be r1, and a dot-to-dot distance may be d.

Meanwhile, as illustrated in FIG. 8B, the radius of the dot formed by adjusting the duty cycle for the low concentration registration may be r2 smaller than r1. At this point, even if the duty cycle is adjusted, only the time during which the exposurer is operated is adjusted and the period is not changed, such that the dot-to-dot distance may be equal to d. In addition, since even the voltage applied to the exposurer is not changed, the darkness level of dots itself may be the same. That is, in the image forming apparatus, the darkness level of dots itself is the same but the size of dots is reduced, such that the registration pattern may be formed at the reduced concentration in general perspective.

As described above, the size of dots is reduced by adjusting the duty cycle, such that the amount of toner used for the registration may be reduced and the cleaning time of the transfer roller may be reduced to shorten the printing time.

Figure 9A:
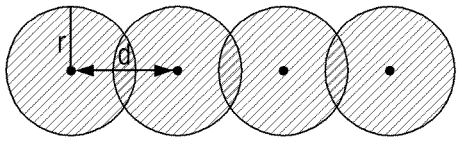
FIGS. 9A and 9B are diagrams for describing an exemplary embodiment in which a concentration of dots is changed to reduce the concentration of the image of a registration pattern.
Figure 9B:
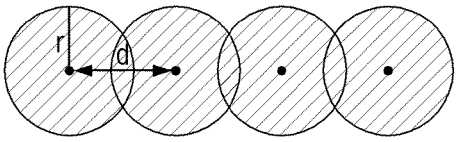

FIGS. 9A and 9B are diagrams for describing an exemplary embodiment in which the darkness level of dots is changed to reduce a concentration of an image of a registration pattern.

Specifically, FIG. 9A may be a dot formed with the duty cycle when the normal printing is performed. At this point, a radius of a dot may be r, and a dot-to-dot distance may be d.

Meanwhile, as illustrated in FIG. 9B, the low concentration registration pattern may be formed by reducing the darkness level of dots. Specifically, the image forming apparatus may reduce the voltage applied to the exposurer so that a small amount of toner is disposed on the photosensitive drum, or reduce the transfer voltage so that only a part of the toner disposed on the photosensitive drum is transferred to the intermediate transfer belt.

Meanwhile, since only the voltage or the transfer voltage applied to the exposurer is reduced and the duty cycle is not changed, the radius of the dot and the distance between the dots may each be the same as r and d. That is, in the image forming apparatus, the size of dots and the dot-to-dot distance are the same but the darkness level of dots itself is reduced, such that the registration pattern may be formed at a reduced concentration.

As described above, by reducing the voltage applied to the exposurer or the transfer voltage transferred to the photosensitive drum, the amount of toner used to perform the registration is reduced and the cleaning time of the transfer roller is reduced to shorten the printing time.

Figure 10:
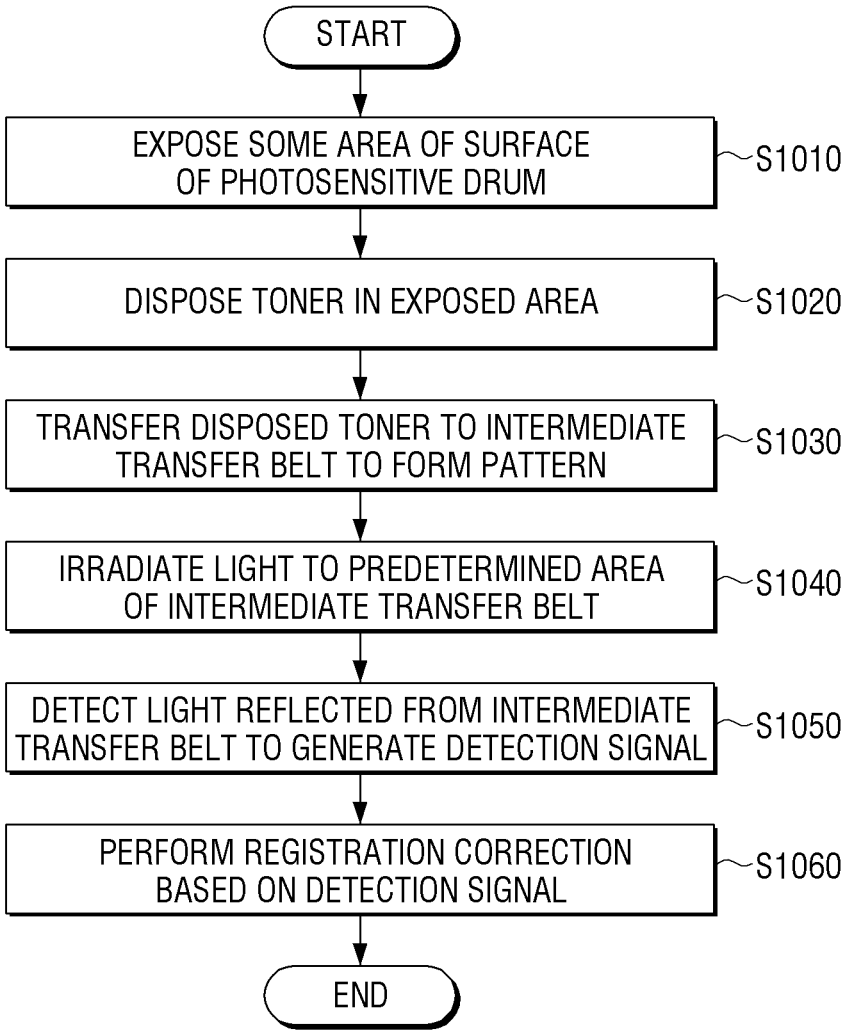
FIG. 10 is a flow chart for describing a method for reducing a concentration of an image of a registration pattern.

FIG. 10 is a flow chart for describing a method of reducing a density of an image of a registration pattern.

Referring to FIG. 10, first, the image forming apparatus may expose some area of the surface of the photosensitive drum (S1010). Specifically, if the print command is input, the image forming apparatus may expose an area corresponding to the printed pattern on the surface of the photosensitive drum at the first duty cycle to form the printed pattern at the predetermined first concentration, and if the registration command is input, expose an area corresponding to the registration pattern of the surface of the photosensitive drum at the second duty cycle smaller than the first duty cycle to form the registration pattern at the second concentration lower than the first concentration.

Meanwhile, the image forming apparatus may reduce the exposure time and reduce the size of dots configuring the registration pattern. At this point, the second duty cycle may be determined by the look-up table stored in the storage of the image forming apparatus or may be determined by comparing the strength of the signals generated by detecting the concentration pattern patch using the sensor provided in the image forming apparatus.

Meanwhile, the image forming apparatus reduces the voltage applied to the exposurer to make the size of dots the same, but may perform a control to dispose a smaller amount of toner on the photosensitive drum.

Next, the image forming apparatus may dispose the toner in the exposed area (S1020). Specifically, the image forming apparatus may dispose the toner in the exposed area of the surface of the photosensitive drum that is the registration pattern area. At this point, the photosensitive drums may be formed in plural corresponding to the respective colors. Meanwhile, if the surface of the photosensitive drum is exposed by a low voltage, the amount of toner having polarity and disposed on the surface of the photosensitive drum may be reduced.

Next, the image forming apparatus may transfer the toner disposed on the surface of the photosensitive drum to the intermediate transfer belt to form the pattern (S1030). Specifically, if the print command is input, the image forming apparatus may supply the first transfer voltage to the photosensitive drum to form the printed pattern at the predetermined first concentration so as to transfer the toner disposed on the surface of the photosensitive drum to the intermediate transfer belt, and if the registration command is input, supply the second transfer voltage lower than the first transfer voltage to the photosensitive drum to form the registration pattern at the second concentration lower than the first concentration so as to transfer the toner disposed on the surface of the photosensitive drum to the intermediate transfer belt.

At this point, the intermediate transfer belt may be sequentially transferred with toners for each color from the plurality of photosensitive drums corresponding to each color.

Next, the image forming apparatus may irradiate light to a predetermined area of the intermediate transfer belt (S1040). Specifically, light may be irradiated to the completed registration pattern on the intermediate transfer belt.

Next, the image forming apparatus may detect the light reflected from the intermediate transfer belt to generate the detection signal (S1050). Specifically, the image forming apparatus may detect the regularly reflected wave reflected from the intermediate transfer belt to generate the detection signal. At this point, the strength of the detection signal may be changed depending on the concentration of the pattern.

Next, the image forming apparatus may perform the registration correction based on the detection signal (S1060). Specifically, the image forming apparatus may correct the location of the registration pattern using the detection signal generated depending on the waveform of the regularly reflected wave, and may correct the concentration using the strength of the detection signal.

As described above, the size of dots is reduced by adjusting the duty cycle or the darkness level of dots is reduced by the magnitude of the exposure voltage or the transfer voltage, such that the amount of toner used for the registration may be reduced and the cleaning time of the transfer roller may be reduced to shorten the printing time.

Further, the method for controlling an image forming apparatus as described above may be implemented by at least one execution program (or application) for executing the method for controlling an image forming apparatus as described above and the execution program may be provided while being stored in a computer readable medium.

The computer readable medium is not a medium that stores data therein for a while, such as a register, a cache, a memory, or the like, but means a medium that semi-permanently stores data therein and is readable by a device. In detail, various applications or programs described above may be stored and provided in readable media such as a compact disk (CD), a digital versatile disk (DVD), a hard disk, a Blu-ray disk, a universal serial bus (USB), a memory card, and a read only memory (ROM). For example, the computer-readable recording medium may be at least one of a memory of the image forming apparatus and a memory of the input/output, or may be a memory included in an external device connected to the image forming apparatus via a network.

Although exemplary embodiments of the present disclosure have been illustrated and described, the present disclosure is not limited to the above-mentioned specific exemplary embodiment, but may be variously modified by those skilled in the art to which the present disclosure pertains without departing from the spirit and scope of the present disclosure as claimed in the claims. In addition, such modifications should also be understood to fall within the scope of the present disclosure.

What is claimed is:

1. An image forming apparatus, comprising:

a plurality of photosensitive drums;

a plurality of exposurers configured to respectively expose areas of surfaces of the plurality of photosensitive drums;

a plurality of developers configured to respectively dispose toner on the exposed areas of the plurality of photosensitive drums;

an intermediate transfer belt configured to receive the toner disposed on each of the exposed areas, to thereby form a pattern on the intermediate transfer belt; and at least one processor configured to control the plurality of photosensitive drums or the plurality of exposurers to form a printed pattern on the intermediate transfer belt at a predetermined first concentration in response to a print command being input, and control the plurality of photosensitive drums or the plurality of exposurers to form a registration pattern on the intermediate transfer belt at a second concentration lower than the first concentration in response to a registration command being input.

2. The image forming apparatus as claimed in claim 1, further comprising:

a light emitter configured to irradiate light to a predetermined area of the intermediate transfer belt; and a sensor configured to detect light reflected from the predetermined area of the intermediate transfer belt to thereby generate a detection signal, wherein the at least one processor controls the light emitter and the sensor to be activated in response to the registration command being input and performs a registration correction based on the detection signal generated by the sensor.

3. The image forming apparatus as claimed in claim 2, wherein a strength of the detection signal for the registration pattern formed at the second concentration is within a predetermined range of strength of the detection signal for the printed pattern formed at the first concentration.

4. The image forming apparatus as claimed in claim 3, wherein the strength of the detection signal for the registration pattern formed at the second concentration for yellow (Y), magenta (M), and cyan (C) colors is equal to a strength of the detection signal for the printed pattern formed at the first concentration.

5. The image forming apparatus as claimed in claim 2, wherein the first concentration and the second concentration are among a plurality of first concentrations and a plurality of second concentrations, respectively, the image forming apparatus further comprises a storage configured to store information on the plurality of second concentrations corresponding to the plurality of first concentrations in a look-up table, respectively, and the information on the plurality of second concentrations includes, for each of the plurality of second concentrations, at least one of a duty cycle, an exposure voltage, and a transfer voltage corresponding to the respective second concentration.

6. The image forming apparatus as claimed in claim 5, wherein the processor updates the look-up table based on a detection signal for a concentration patch pattern differentiated from the registration pattern.

7. The image forming apparatus as claimed in claim 1, wherein to carry out forming of the printed pattern on the intermediate transfer belt in response to the print command being input, the at least one processor controls the plurality of exposurers to expose an area, corresponding to the printed pattern, of the respective surfaces of the plurality of photosensitive drums at a predetermined first duty cycle, and to carry out forming of the registration pattern on the intermediate transfer belt in response to the print registration being input, the at least one processor controls the plurality of exposurers to expose an area, corresponding to the registration pattern, of the respective surfaces of the plurality of photosensitive drums at a second duty cycle smaller than the first duty cycle in response to the registration command being input.

8. The image forming apparatus as claimed in claim 1, wherein to carry out forming of the printed pattern on the intermediate transfer belt in response to the print command being input, the at least one processor supplies a predetermined first voltage to the exposurer, and to carry out forming of the registration pattern on the intermediate transfer belt in response to the registration command being input, the at least one processor supplies a second voltage lower than the first voltage to the plurality of exposurers.

9. The image forming apparatus as claimed in claim 1, wherein to carry out forming of the printed pattern on the intermediate transfer belt in response to the print command being input, the at least one processor supplies a predetermined first transfer voltage to the plurality of photosensitive drums, and to carry out forming of the registration pattern on the intermediate transfer belt in response to the registration command being input, the at least one processor supplies the second transfer voltage lower than the first transfer voltage to the plurality of photosensitive drums.

10. The image forming apparatus as claimed in claim 9, further comprising:

a plurality of blades configured to clean a residual toner remaining on each of the plurality of photosensitive drums after the toner is transferred to the intermediate transfer belt depending on the supplied second transfer voltage.

11. A method for controlling an image forming apparatus including an intermediate transfer belt and configured to form a printed pattern on the intermediate transfer belt at a predetermined first concentration in response to a print command being input, the method comprising:

in response to a registration command being input, exposing some area of surfaces of each of a plurality of photosensitive drums of the image forming apparatus, disposing toner in the exposed area on the surfaces of each of the plurality of photosensitive drums, and transferring the toner disposed on each of the plurality of photosensitive drums to the intermediate transfer belt to form a registration pattern on the intermediate transfer belt at a second concentration lower than the first concentration.

12. The method as claimed in claim 11, further comprising:

irradiating light to a predetermined area of the intermediate transfer belt if the registration command is input;

generating a detection signal by detecting light reflected from the predetermined area of the intermediate transfer belt; and performing a registration correction based on the detection signal.

13. The method as claimed in claim 12, wherein a strength of the detection signal for the registration pattern formed at the second concentration is within a predetermined range of strength of the detection signal for the printed pattern formed at the first concentration.

14. The method as claimed in claim 13, wherein the strength of the detection signal for the registration pattern formed at the second concentration for yellow (Y), magenta (M), and cyan (C) colors is equal to a strength of the detection signal for the printed pattern formed at the first concentration.

15. The method as claimed in claim 12, wherein the first concentration and second concentration are among a plurality of first concentrations and a plurality of second concentrations, respectively, and the image forming apparatus, the method further comprises storing information on a plurality of second concentrations corresponding to a plurality of first concentrations in a look-up table, and the information on the plurality of second concentrations includes, for each of the plurality of second concentrations, at least one of a duty cycle, an exposure voltage, and a transfer voltage corresponding to the respective second concentration.

16. The method as claimed in claim 15, further comprising:

updating the look-up table based on a detection signal for a concentration patch pattern differentiated from the registration pattern.

17. The method as claimed in claim 11, wherein to form the printed pattern on the intermediate transfer belt in response to the print command being input, the image forming apparatus is configured to perform exposure of an area, corresponding to the printed pattern, of the respective surfaces of each of the plurality of photosensitive drums is exposed at a predetermined first duty cycle, and in the exposing in response to the registration command being input, an area, corresponding to the registration pattern, of the respective surfaces of the plurality of photosensitive drums is exposed at a second duty cycle smaller than the first duty cycle.

18. The method as claimed in claim 11, wherein to form the printed pattern on the intermediate transfer belt in response to the print command being input, the image forming apparatus is configured to perform exposure at a predetermined first voltage, and the exposing in response to the registration command being input is performed at the second voltage lower than the first voltage.

19. The method as claimed in claim 11, wherein to form the printed pattern on the intermediate transfer belt in response to the print command being input, the image forming apparatus is configured to supply a predetermined first transfer voltage to the plurality of photosensitive drums, and in the forming the registration pattern, a second transfer voltage lower than the first transfer voltage is supplied to the plurality of photosensitive drums.

20. A non-transitory computer-readable recording medium storing a program that, when executed by at least one processor of an image forming apparatus, executes a method for controlling an image forming apparatus, wherein the image forming apparatus includes an intermediate transfer belt and configured to form a printed pattern on the intermediate transfer belt at a predetermined first concentration in response to a print command being input, and the method for controlling an image forming apparatus includes, in response to detecting the input of the registration command:

exposing some area of surfaces of each of a plurality of photosensitive drums of the image forming apparatus;

disposing a toner in the exposed area on the surfaces of each of the plurality of photosensitive drums; and transferring the toner disposed on each of the plurality of photosensitive drums to the intermediate transfer belt to form a registration pattern on the intermediate transfer belt at a second concentration lower than the first concentration.

* * * * *